United States Patent [19]

Tanney

[11] 4,332,095

[45] Jun. 1, 1982

[54] PICTURE HOLDER

[75] Inventor: Oliver M. Tanney, Englewood, N.J.

[73] Assignee: Goodren Products Corp., Englewood, N.J.

[21] Appl. No.: 144,262

[22] Filed: Apr. 28, 1980

[51] Int. Cl.[3] ..... G09F 1/12

[52] U.S. Cl. ..... 40/158 R; 40/152.1

[58] Field of Search ..... 40/158 R, 158 B, 152.1, 40/152, 158

[56] References Cited

U.S. PATENT DOCUMENTS

| | | | |
|---|---|---|---|
| 2,329,007 | 9/1943 | Simon et al. | 40/152.1 X |
| 2,598,755 | 6/1952 | Birch | 40/158 R |
| 2,845,733 | 8/1958 | Fox | 40/152.1 |
| 2,942,368 | 6/1960 | Gale | 40/158 R |
| 3,024,553 | 3/1962 | Rowley | 40/158 R |
| 3,174,244 | 3/1965 | Walton | 40/158 R |
| 3,701,209 | 10/1972 | Kobusch | 40/152.1 |
| 3,836,419 | 9/1974 | Hamberger | 40/152.1 |

*Primary Examiner*—Gene Mancene
*Assistant Examiner*—Wenceslao J. Contreras
*Attorney, Agent, or Firm*—Brumbaugh, Graves, Donohue & Raymond

[57] ABSTRACT

A holder for photographs or the like is comprised of an elongated sheet of clear plastic adapted to be folded in half to form an inverted -V- configuration. An opaque layer is imprinted on one surface of the plastic with openings in the layer to provide frames for photographs to be displayed. The photographs are mounted behind the framed openings by means of adhesive strips which engage portions of the photographs not visible through the framed openings. The plastic is of sufficient thickness to enable the holder to be self-supporting on a flat surface when folded.

1 Claim, 2 Drawing Figures

PICTURE HOLDER

BACKGROUND OF THE INVENTION

This invention relates to picture holders, more particularly, to an improved arrangement for mounting photographs and the like, which combines ease of manufacture, low cost and simplicity of mounting.

A wide variety of frame constructions are available in the market for supporting photographs or other pictures upright on a flat surface, such as a desk or shelf, to permit ready viewing. Typically, these frames include a holding structure in which the photograph is mounted, often behind glass, and an easel or support construction which holds the frame in a vertical or near vertical attitude. Such frames are generally made of metal or plastic and can be highly decorative in appearance.

A less expensive modification of this frame construction, often given away with prints of photographs by photography studios, typically consists of a paperboard frame with a fold-out easel construction also formed of paperboard. These frames generally are made of two or more layers of paperboard, the front frame layer being provided with an opening behind which the photograph to be displayed is mounted. Ordinarily, no glass or protection for the photograph itself is provided in these frames. Although considerably less expensive than the more decorative metal or plastic frames discussed above, these paperboard frames nevertheless are relatively costly to produce, involving gluing of several sheets of paperboard, cutting, scoring, etc., as well as printing or embossing for decorative effect on the face of the frame element. These frames are also quite flimsy in construction and easily damaged or torn.

SUMMARY OF THE INVENTION

The present invention provides an inexpensive, easily made frame and support for photographs which not only frames and supports the photograph, but protects the surface of the photograph from direct touch and other damaging contacts.

Briefly, the picture holder according to the invention, comprises a sheet of clear material, such as vinyl plastic, folded in half to form an inverted —V— configuration. The plastic material is sufficiently rigid such that when folded, it will be self-supporting on a flat surface. On one surface of the plastic material is provided an opaque framing layer, preferably by imprinting with ink, leaving one or more openings through which the photograph or photographs to be mounted can be viewed. Mounting is easily achieved by means of an adhesive strip placed outside of the frame opening and covered by release paper such that when the release paper is removed, the photograph can be placed with its picture side against the frame opening and with a portion of its surface outside of the framed portion against the now exposed adhesive material.

The inverted —V— construction may be provided with two frame openings in the opaque layer, one in each leg of the inverted —V—, so that the completed picture holder can hold two photographs for display.

Preferably the size of the holder is such that each leg of the —V— is essentially the same size as the outer dimensions of the photograph to be mounted, so that when photographs are mounted in each leg of the —V—, their upper edges meet at the interior corner of the fold and, thus, enhance the rigidity of the structure.

BRIEF DESCRIPTION OF THE DRAWINGS

The features of the invention will be more readily apparent from the following detailed description thereof when taken in conjunction with the appended drawings, in which.

DETAILED DESCRIPTION OF THE INVENTION

Figure 1:
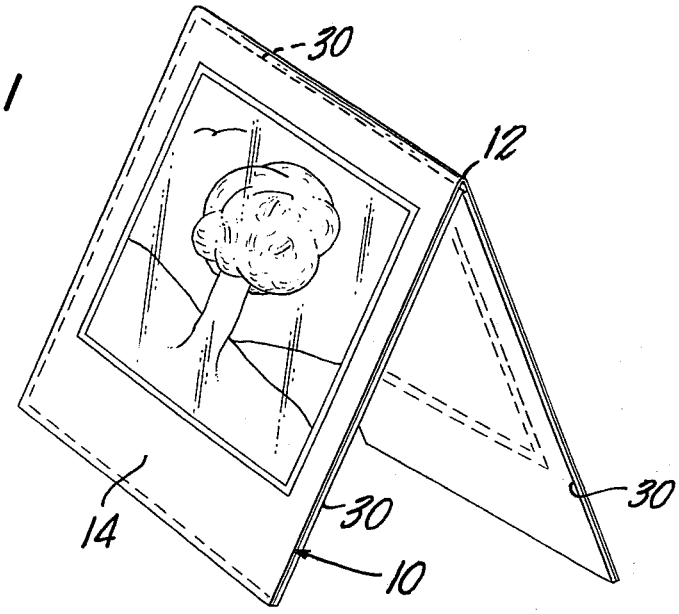
FIG. 1 is a pictorial representation of the picture holder of the invention in erected form.

The structure of the invention comprises an elongated sheet of transparent material 10, preferably plastic of the type known as "window glass clear" vinyl sheet, sufficiently rigid to retain a permanent crease when folded and to remain upright in an inverted —V— position, as seen in FIG. 1. For this purpose, the plastic sheet should be 0.010 inch in thickness or more.

Figure 2:
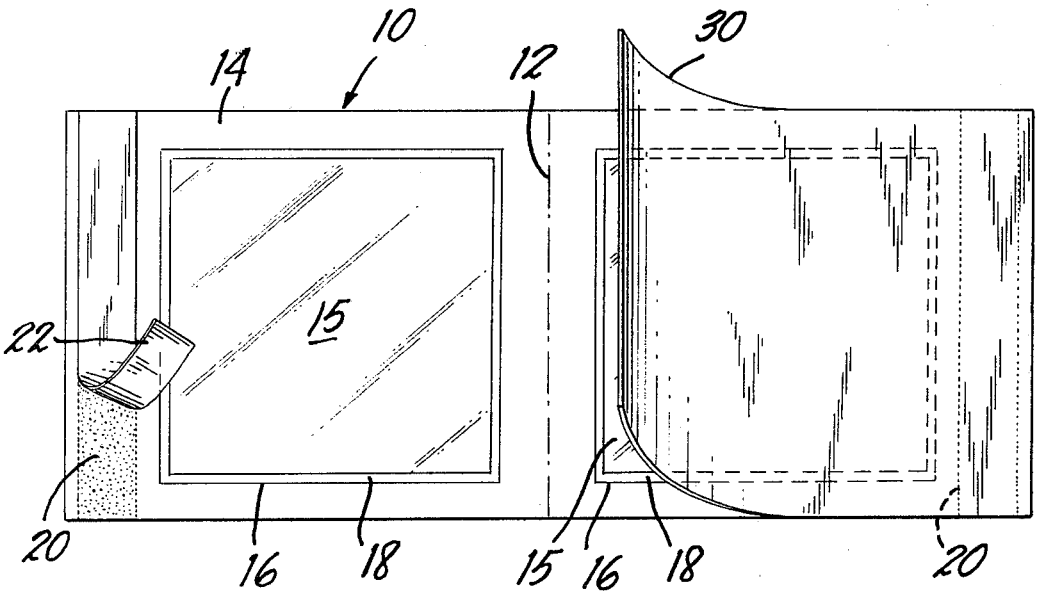
FIG. 2 illustrates the picture holder of the invention before folding and depicting the manner of attaching the photograph to the frame.

As seen in FIG. 2, the plastic sheet 10 is provided with a score or fold line 12 at its longitudinal midpoint. On one surface of the sheet 10 is imprinted an opaque layer 14, which may be of any ink which will suitably and permanently adhere to the plastic surface. The opaque layer may be deposited either on what will be the interior surface of the inverted —V— holder or on the outer surface, depending upon the texture and visual effects desired.

The opaque layer 14 does not extend over the entire surface but is formed with an opening 16 which provides a transparent window 15 for viewing the photograph to be mounted. In the preferred embodiment, similar openings 16 are formed in the opaque layers on both sides of the fold line 12, as shown in FIG. 2. The layer 14 may be in any color desired and may have an inner rim 18 of a contrasting or distinguishing color to enhance the decorative effect.

Mounting means for the photographs are provided on the interior surface of the sheet over the opaque layer, so that it is not visible from the viewing side. Preferably, the mounting means comprises an adhesive material 20 laid down as a narrow strip and covered with release paper 22, in well known fashion.

To simplify manufacture, it is preferable that the opaque layer be formed on the same side of the plastic sheet 10 as the mounting means so that all of the manufacturing processes can be carried out on one side of the plastic sheet, eliminating the need to turn the material during processing.

FIG. 2 illustrates how a photograph 30 would be mounted on the holder. First, the release paper 22 would be removed, exposing the adhesive. The photograph 30 would then be placed such that the side bearing the picture faces the framed opening 16. The portion of the photograph atop the adhesive is then pressed to secure it to the surface. A second photograph may then be mounted on the other leg of the folder, as indicated in FIG. 1. The sheet 10 may be folded at 12 either before or after mounting of the photographs. The mounted photographs lend rigidity to the holder, especially when their upper edges meet at the interior corner of the fold.

In one specific application of the invention, each half of the holder is dimensioned to be substantially the same size as the self-developing prints produced by Polaroid. These prints have a viewing area of approximately $3\frac{1}{8}$ inches square and are surrounded by a border which is narrow on the two sides and top and wider at the bottom. Thus, the adhesive 20 will secure the print to the frame along its lower border, leaving the entire picture area viewable through the window 15.

The outer dimensions of the frame holder, as well as the size of the frame opening 16, may be varied to accommodate photographs of varying sizes and the location of the mounting adhesive may also be selected to accommodate the photograph to be mounted. The shape of the framed opening may also be varied to provide different decorative effects and more than one framed opening may be provided on each leg of the holder. If desired, only one leg of the holder may be provided with a framed opening and mounting means, the other leg being entirely coated with opaque material.

The imprinting process for applying the opaque layer also enables an advertising message, for example, to be provided on the folder, making the product suitable for promotional premiums or giveaways. For example, a supply of folders may be included with each package of film sold to a retail purchaser, either at no or nominal cost, each holder bearing the name of the dealer or some other advertising message. Alternatively, the holders may be imprinted on order with the name of the purchaser or other message that he may wish.

As can be seen from the foregoing, the novel construction of the present invention provides an inexpensive, versatile and effective holder for photographs and the like which lends itself to a variety of merchandising techniques and, at the same time, provides an effective and protective means for displaying photographs. It will be apparent that modifications of the disclosed structure will occur to those skilled in the art and the scope of the invention is to be limited only as set forth in the appended claims.

I claim:

1. A holder for photographs and the like, comprising, a sheet of transparent material adapted to be folded along a transverse line to retain a permanent crease, said transparent material being of sufficient rigidity to enable said sheet, when folded, to stand upright in an inverted —V— position, with edges remote from the fold forming the bottom edges of the upright holder, an opaque layer on one surface of said sheet, said layer extending on both sides of said transverse fold line and having at least one opening therein, means for mounting a photograph or the like against one side of said sheet over said opening such that only the portion of photograph desired to be exposed to view would be visible from the other side of said sheet, said mounting means comprising an adhesive on said sheet outside of said opening and limited to locations proximate a bottom edge, and a strip of sheet material normally covering said adhesive and adapted to be readily removed to expose said adhesive to enable the photograph to be secured to said sheet.

* * * * *

UNITED STATES PATENT AND TRADEMARK OFFICE

CERTIFICATE OF CORRECTION

PATENT NO. : 4,332,095

DATED : June 1, 1982

INVENTOR(S) : Oliver M. Tanney

It is certified that error appears in the above—identified patent and that said Letters Patent is hereby corrected as shown below:

Title page, first col., Item 56, following the first patent cited, insert --2,490,638 12/1949 Kubec 40/154--.

Signed and Sealed this

*Fourteenth* Day of *September 1982*

[SEAL]

*Attest:*

GERALD J. MOSSINGHOFF

*Attesting Officer* *Commissioner of Patents and Trademarks*